US010837322B2

(12) United States Patent
Kano

(10) Patent No.: US 10,837,322 B2
(45) Date of Patent: Nov. 17, 2020

(54) OPPOSED PISTON TYPE ENGINE

(71) Applicant: ISHIKAWA ENERGY RESEARCH CO., LTD., Ota (JP)

(72) Inventor: Toru Kano, Ota (JP)

(73) Assignee: ISHIKAWA ENERGY RESEARCH CO., LTD., Ota (JP)

( * ) Notice: Subject to any disclaimer, the term of this patent is extended or adjusted under 35 U.S.C. 154(b) by 0 days.

(21) Appl. No.: 16/480,162

(22) PCT Filed: Jul. 5, 2017

(86) PCT No.: PCT/JP2017/024634

§ 371 (c)(1),
(2) Date: Jul. 23, 2019

(87) PCT Pub. No.: WO2018/138947

PCT Pub. Date: Aug. 2, 2018

(65) Prior Publication Data

US 2019/0338679 A1 Nov. 7, 2019

(30) Foreign Application Priority Data

Jan. 26, 2017 (JP) ..... 2017-012353

(51) Int. Cl.
*F01B 7/14* (2006.01)
*F01L 1/02* (2006.01)
(Continued)

(52) U.S. Cl.
CPC ..... *F01L 1/02* (2013.01); *F01B 7/14* (2013.01); *F01M 1/02* (2013.01); *F02B 75/28* (2013.01); *F02B 75/40* (2013.01); *F02F 7/0021* (2013.01)

(58) Field of Classification Search
CPC ... F01B 7/14; F01L 1/026; F01L 1/047; F01L 1/46; F01M 1/02; F01M 9/10;
(Continued)

(56) References Cited

U.S. PATENT DOCUMENTS 3,895,620 A 7/1975 Foster
6,250,263 B1 6/2001 Sisco
(Continued)

FOREIGN PATENT DOCUMENTS

CN 103321744 A 9/2013
JP 62-14342 Y2 4/1987
(Continued)

OTHER PUBLICATIONS

International Search Report dated Oct. 3, 2017, issued in counterpart International Application No. PCT/JP2017/024634, with English Translation. (5 pages).
(Continued)

*Primary Examiner* — Jorge L Leon, Jr.
(74) *Attorney, Agent, or Firm* — Westerman, Hattori, Daniels & Adrian, LLP

(57) ABSTRACT

Provided is an opposed-piston engine which attains high output, ensures combustion toughness, and includes a simplified configuration of a crankshaft counter-rotation synchronization mechanism which rotates crankshafts in engine units in opposite directions. An opposed-piston engine 10 of the present invention includes a first engine unit 11 and a second engine unit 21. The first engine unit 11 and the second engine unit 21 respectively include a first cylinder 12 and a second cylinder 22 independent of each other. In addition, a first valve driving mechanism 19 and a second valve driving mechanism 20 which control valves also function as a crankshaft counter-rotation synchronization mechanism 29 which rotates a first crankshaft 14 of the first engine unit 11 and a second crankshaft 24 of the second engine unit 21 in the opposite directions.

5 Claims, 3 Drawing Sheets

(51) Int. Cl.

| | |
|---|---|
| ***F01M 1/02*** | (2006.01) |
| ***F02B 75/28*** | (2006.01) |
| ***F02B 75/40*** | (2006.01) |
| ***F02F 7/00*** | (2006.01) |

(58) Field of Classification Search
CPC ..... F01M 9/106; F02B 75/24; F02B 75/28; F02B 75/40; F02F 7/0009
USPC ..... 123/90.17, 90.31, 90.38
See application file for complete search history.

(56) References Cited

U.S. PATENT DOCUMENTS

| | | | | |
|---|---|---|---|---|
| 2007/0251479 | A1 | 11/2007 | Takada et al. | |
| 2008/0047530 | A1 | 2/2008 | Cleeves | |
| 2013/0239930 | A1 | 9/2013 | Leone et al. | |
| 2014/0102418 | A1* | 4/2014 | Babu | F01B 7/14 123/51 R |

FOREIGN PATENT DOCUMENTS

| | | | |
|---|---|---|---|
| JP | 63-167031 | A | 7/1988 |
| JP | 2009-534578 | A | 9/2009 |
| JP | 4583339 | B2 | 11/2010 |
| JP | 5508604 | B2 | 6/2014 |
| JP | 2016-166598 | A | 9/2016 |
| WO | 2015/104496 | A1 | 7/2015 |

OTHER PUBLICATIONS

Notification of Reasons for Refusal dated May 28, 2019, issued in counterpart of Japanese Patent Application No. 2017-012353 with English Translation (8 pages).

* cited by examiner

OPPOSED PISTON TYPE ENGINE

TECHNICAL FIELD

The present invention relates to an opposed-piston engine, and in particular relates to an opposed-piston engine in which engine units arranged opposed to each other individually include independent cylinders and other components.

BACKGROUND ART

Heretofore, opposed-piston engines having a vibration reducing effect and so on have been developed. In an opposed-piston engine of this type, two pistons opposed to each other are configured to reciprocate linearly to produce a damping effect during an engine operation.

Patent Literature 1 describes an example of the aforementioned opposed-piston engines. Specifically, in this opposed-piston engine, a single cylinder is formed in an engine block, and two piston heads reciprocate while being opposed to each other inside the cylinder. In addition, a volume space continuing to this cylinder is formed, and an intake valve, an exhaust valve, and a spark plug are placed in the volume space. Thus, the process of assembling the cylinder is simplified to enhance the efficiency of casting the cylinder.

CITATION LIST

Patent Literature

Patent Literature 1: Japanese Patent No. 5508604

SUMMARY OF INVENTION

Technical Problems

However, the aforementioned engine described in Patent Literature 1 has difficulty achieving high output, and still has room to improve combustion toughness due to the complicated shape of the combustion chamber.

Specifically, in the engine according to the background art, since the intake port and the exhaust port are placed in the volume space formed to extend to one side from the cylinder as described above, the intake port, the exhaust port, and the cylinder are assembled together in such a complicated form that the intake efficiency and the exhaust efficiency are enviably low. Hence, there is a problem that it is not easy to increase the output from the engine.

In addition, as described above, the complicated shape of the combustion chamber including the cylinder and the volume space also poses problems of, for example, an increase in the HC (hydrocarbon) emission amount at low temperature and a decrease in combustion toughness. Moreover, the combustion chamber including the cylinder and the volume space has a shape different from the shape of the cylinder included in a common engine. This entails a problem of a local deformation of the cylinder due to non-uniform heat transfer during an engine operation.

Further, the engine described in Patent Literature 1 includes a crankshaft counter-rotation synchronization mechanism including multiple gears, timing belts, and others in order to synchronize rotations in the opposite directions of the crankshaft on one side and the crankshaft on the other side. As a result, the engine includes the dedicated components for the above mechanism and therefore has problems of the complicated configuration and the increased weight of the entire engine.

The present invention was made in light of the aforementioned circumstances, and has an object to provide an opposed-piston engine capable of achieving high output, improvement in combustion toughness, and simplification of the configuration of a crankshaft counter-rotation synchronization mechanism that synchronizes rotations in the opposite directions of crankshafts included in engine units.

Solution to Problems

An opposed-piston engine of the present invention includes: a first engine unit including a first cylinder, a first piston which reciprocates inside the first cylinder, a first crankshaft which converts reciprocating motion of the first piston into rotating motion, a first connecting rod which connects the first piston and the first crankshaft in a movable manner, and a first valve which is provided for the first cylinder; a second engine unit including a second cylinder which is separate from and opposed to the first cylinder, a second piston which reciprocates inside the second cylinder, a second crankshaft which converts reciprocating motion of the second piston into rotating motion, a second connecting rod which connects the second piston and the second crankshaft in a movable manner, and a second valve which is provided for the second cylinder; a valve driving mechanism which drives the first valve and the second valve by the rotating motion of the first crankshaft or the second crankshaft; and a crankshaft counter-rotation synchronization mechanism by which a rotation direction of the first crankshaft in the first engine unit and a rotation direction of the second crankshaft in the second engine unit are set opposite to each other, and is characterized in that the valve driving mechanism functions as the crankshaft counter-rotation synchronization mechanism.

The opposed-piston engine of the present invention is characterized in that the first engine unit includes a first intake valve arranged on one of lateral sides in an array direction of the first cylinder and the second cylinder, and a first exhaust valve arranged on the other lateral side, the second engine unit includes a second intake valve arranged on one of lateral sides in the array direction of the first cylinder and the second cylinder, and a second exhaust valve arranged on the other lateral side, and the valve driving mechanism controls opening and closing of the first intake valve and the second intake valve by using a driving force of the first crankshaft and controls opening and closing of the first exhaust valve and the second exhaust valve by using a driving force of the second crankshaft.

The opposed-piston engine of the present invention is characterized in that the crankshaft counter-rotation synchronization mechanism is formed by causing a first counter-rotating gear and a second counter-rotating gear to mesh with each other, the first counter-rotating gear configured to be rotated by the driving force of the first crankshaft and connected to a first camshaft together with a cam which operates the first valve or the second valve, the second counter-rotating gear configured to be rotated by the driving force of the second crankshaft and connected to a second crankshaft together with a cam which operates the first valve or the second valve.

The opposed-piston engine of the present invention is characterized by further comprising an oil pan which is arranged in a center location near the first cylinder and the second cylinder, and stores oil which is to circulate through the first engine unit and the second engine unit.

The opposed-piston engine of the present invention is characterized by further comprising an oil pump which is arranged near the first cylinder and the second cylinder, and is driven by the valve driving mechanism.

Advantageous Effects of Invention

The opposed-piston engine of the present invention includes the first engine unit including the first cylinder, the first piston which reciprocates inside the first cylinder, the first crankshaft which converts the reciprocating motion of the first piston into the rotating motion, the first connecting rod which connects the first piston and the first crankshaft in the movable manner, and the first valve which is provided for the first cylinder; the second engine unit including the second cylinder which is separate from and opposed to the first cylinder, the second piston which reciprocates inside the second cylinder, the second crankshaft which converts the reciprocating motion of the second piston into the rotating motion, the second connecting rod which connects the second piston and the second crankshaft in the movable manner, and the second valve which is provided for the second cylinder; the valve driving mechanism which drives the first valve and the second valve by the rotating motion of the first crankshaft or the second crankshaft; and the crankshaft counter-rotation synchronization mechanism by which the rotation direction of the first crankshaft in the first engine unit and the rotation direction of the second crankshaft in the second engine unit are set opposite to each other, and is characterized in that the valve driving mechanism functions as the crankshaft counter-rotation synchronization mechanism. Thus, since the first cylinder and the second cylinder are formed as substantially cylindrical spaces, the output can be increased by enhancing the intake efficiency and the exhaust efficiency. In addition, the heat transfer in the first cylinder and the second cylinder during the operation of the opposed-piston engine can be made substantially uniform, so that deformation of the first cylinder and the second cylinder during the operation is suppressed. Further, in order to reduce vibrations during the operation, the opposed-piston engine includes the crankshaft counter-rotation synchronization mechanism by which the rotation direction of the first crankshaft and the rotation direction of the second crankshaft are set opposite to each other. In this regard, in the present invention, the valve driving mechanism also functions as the crankshaft counter-rotation synchronization mechanism. Thus, the engine can be equipped with a damper mechanism without involving an increase in the number of components.

The opposed-piston engine of the present invention is characterized in that the first engine unit includes the first intake valve arranged on the one lateral side in the array direction of the first cylinder and the second cylinder, and the first exhaust valve arranged on the other lateral side, the second engine unit includes the second intake valve arranged on the one lateral side in the array direction of the first cylinder and the second cylinder, and the second exhaust valve arranged on the other lateral side, and the valve driving mechanism controls opening and closing of the first intake valve and the second intake valve by using the driving force of the first crankshaft and controls opening and closing of the first exhaust valve and the second exhaust valve by using the driving force of the second crankshaft. Thus, the configuration in which the first crankshaft controls the opening and closing of the first intake valve and the second intake valve and the second crankshaft controls the opening and closing of the first exhaust valve and the second exhaust valve makes it possible to enhance the intake efficiency and the exhaust efficiency in the first engine unit and the second engine unit.

The opposed-piston engine of the present invention is characterized in that the crankshaft counter-rotation synchronization mechanism is formed by causing the first counter-rotating gear and the second counter-rotating gear to mesh with each other, the first counter-rotating gear configured to be rotated by the driving force of the first crankshaft and connected to the first camshaft together with the cam which operates the first valve or the second valve, the second counter-rotating gear configured to be rotated by the driving force of the second crankshaft and connected to the second crankshaft together with the cam which operates the first valve or the second valve. Thus, the configuration in which the first counter-rotating gear and the second counter-rotating gear mesh with each other makes it possible to rotate the first crankshaft and the second crankshaft in the opposite directions. As a result, the crankshaft counter-rotation synchronization mechanism can be configured without adding many other dedicated components.

The opposed-piston engine of the present invention is characterized by further comprising the oil pan which is arranged in the center location near the first cylinder and the second cylinder, and stores the oil which is to circulate through the first engine unit and the second engine unit. Thus, as compared with a case where an engine includes oil pans joined to respective engine crankcases, the configuration of the engine can be simplified, which enables reductions in the size and the weight.

The opposed-piston engine of the present invention is characterized by further comprising the oil pump which is arranged near the first cylinder and the second cylinder, and is driven by the valve driving mechanism. Thus, the oil pump can be shared by the first engine unit and the second engine unit, so that the configuration of the engine can be simplified, which enables reductions in the size and the weight.

BRIEF DESCRIPTION OF THE DRAWINGS

FIGS. 1A and 1B includes views illustrating an opposed-piston engine according to an embodiment of the present invention, in which FIG. 1A is a top view and FIG. 1B is a side view.

FIGS. 2A and 2B includes views illustrating extracted portions of the opposed-piston engine according to the embodiment of the present invention, in which FIG. 2A is a top view and FIG. 2B is a side view.

DESCRIPTION OF EMBODIMENTS

Figure 1A:
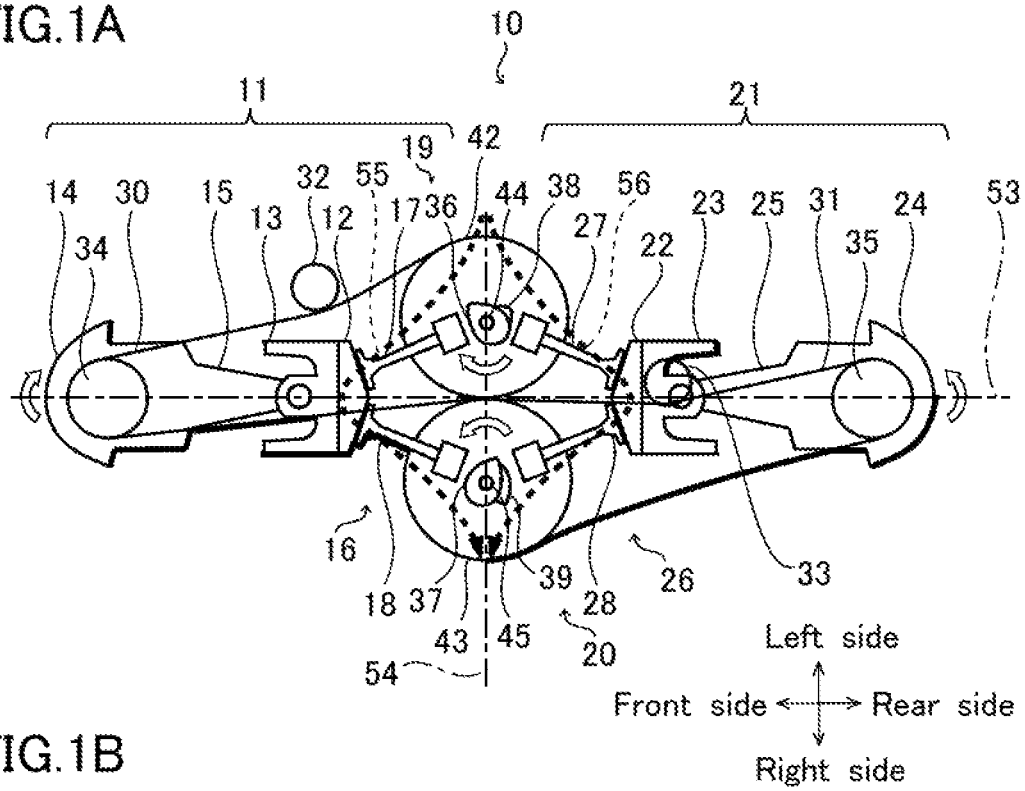

Hereinafter, an opposed-piston engine 10 according to an embodiment is described in terms of a configuration and operations with reference to the drawings.

In the following description, the front, rear, top, bottom, right, and left directions are used as needed. Here, the front indicates a direction of a side where reciprocation of a first piston 13 in a first engine unit 11 takes place, and the rear indicates a direction of a side where reciprocation of a second piston 23 in a second engine unit 21 takes place. Then, the top indicates a direction in which a crank pulley 34 and the like to be described later are arranged with respect to a first crankshaft 14 and the like, and the bottom indicates a direction opposite to the top. In addition, the right and the left indicate the right side and the left side of the opposed-piston engine 10 when viewed from the front side.

Figure 1B:
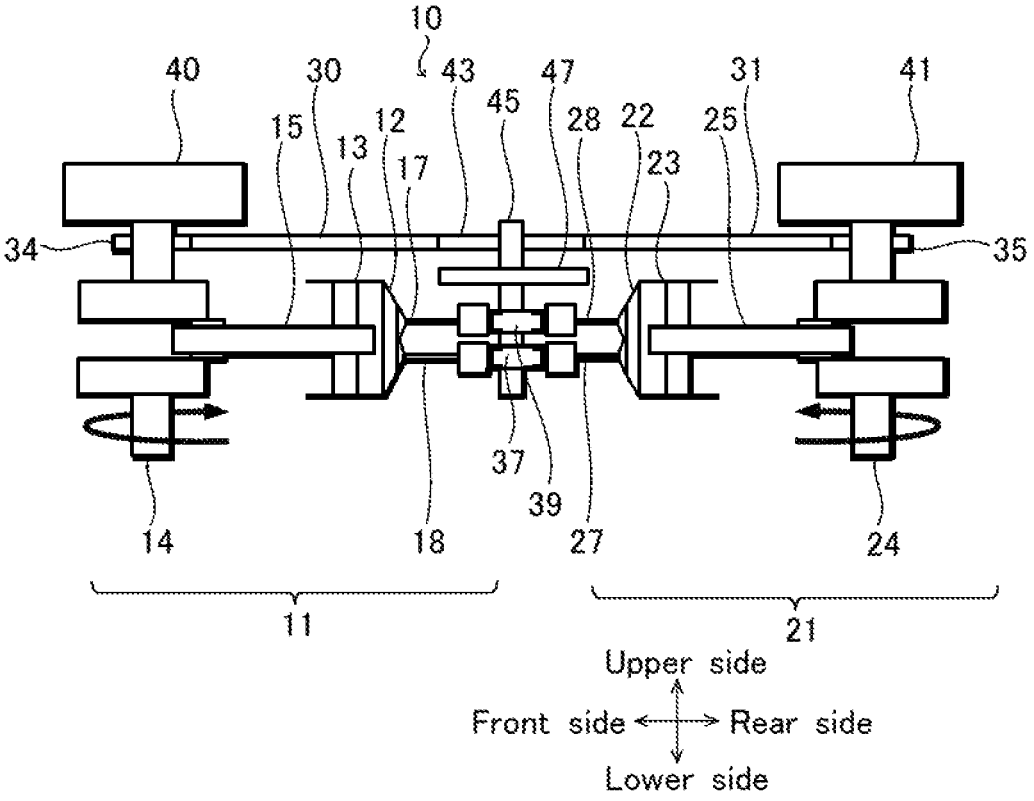

With reference to FIG. 1, a basic configuration of the opposed-piston engine 10 is described. FIG. 1A is a top view of the opposed-piston engine 10 viewed from above, and FIG. 1B is a side view of the opposed-piston engine 10 viewed from the right side.

With reference to FIGS. 1A and 1B, the opposed-piston engine 10 includes the first engine unit 11 arranged on the front side and the second engine unit 21 arranged on the rear side.

Figure 3:
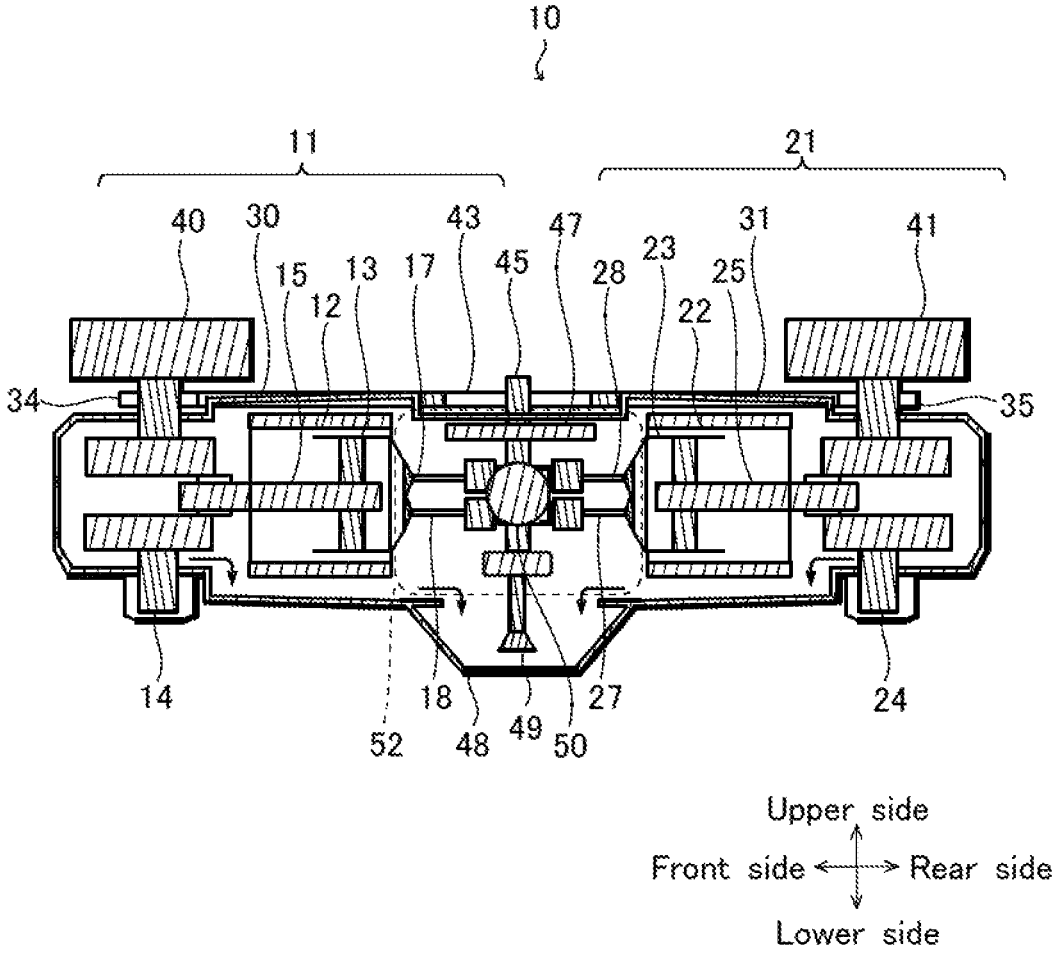
FIG. 3 is a side view illustrating an opposed-piston engine according to another embodiment of the present invention.

The first engine unit 11 includes a first cylinder 12, a first piston 13 which reciprocates inside the first cylinder 12, a first crankshaft 14 which converts reciprocating motion of the first piston 13 into rotating motion, a first connecting rod 15 which connects the first piston 13 and the first crankshaft 14 to each other in a movable manner, and first valves 16 provided for a cylinder head 52 (see FIG. 3). The first valves 16 include a first intake valve 17 and a first exhaust valve 18. In addition, the first crankshaft 14 is connected to a first load 40 which is, for example, a power generator.

The second engine unit 21 includes a second cylinder 22, a second piston 23 which reciprocates inside the second cylinder 22, a second crankshaft 24 which converts reciprocating motion of the second piston 23 into rotating motion, a second connecting rod 25 which connects the second piston 23 and the second crankshaft 24 to each other in a movable manner, and second valves 26 provided for the cylinder head 52 (see FIG. 3). The second valves 26 include a second intake valve 27 and a second exhaust 28. In addition, the second crankshaft 24 is connected to a second load 41 which is, for example, a power generator.

Here, the first engine unit 11 and the second engine unit 21 described above may be housed in an engine block integrally formed by casting, or be housed individually in engine blocks. In the case where the first engine unit 11 and the second engine unit 21 are housed individually in the engine blocks, the engine blocks are joined together In the opposed-piston engine 10, the main components included in the first engine unit 11 and the second engine unit 21 are arranged on an imaginary line 53 defined along the front-rear direction. Specifically, the first cylinder 12, the first piston 13, the first crankshaft 14, and the first connecting rod 15 in the first engine unit 11 are arranged on the imaginary line 53. Then, the second cylinder 22, the second piston 23, the second crankshaft 24, and the second connecting rod 25 in the second engine unit 21 are also arranged on the imaginary line 53. When the components in the engine units are arranged on the imaginary line 53 as described above, vibrations generated along with the operations of the engine units cancel out each other and therefore the damping effect can be enhanced.

Moreover, the first engine unit 11 and the second engine unit 21 are arranged in line symmetry with respect to an imaginary line 54 defined in the right-left direction. This configuration also enhances the damping effect by canceling out the vibrations generated along with the operations of the engine units.

With reference to FIGS. 1A and 1B, the first engine unit 11 includes a first valve driving mechanism 19 which controls operations of the first intake valve 17 and the second intake valve 27.

The first valve driving mechanism 19 includes the crank pulley 34, a cam pulley 42, and a timing belt 30 wrapped around the crank pulley 34 and the cam pulley 42. The crank pulley 34 is connected to a portion of the first crankshaft 14 leading to the outside. The cam pulley 42 is connected to a camshaft 44 together with a first intake cam 36 which controls advancing-and-retracting motion of the first intake valve 17 by coming into contact with the first intake valve 17 and a second intake cam 38 which controls advancing-and-retracting motion of the second intake valve 27 by coming into contact with the second intake valve 27. The first intake cam 36 and the second intake cam 38 are connected to the camshaft 44 with such a phase difference that the timing at which the first intake cam 36 presses the first intake valve 17 and the timing at which the second intake cam 38 presses the second intake valve 27 come concurrently. In addition, a tensioner 32 for applying tension to the timing belt 30 is arranged.

A second valve driving mechanism 20 includes a crank pulley 35, a cam pulley 43, and a timing belt 31 wrapped around the crank pulley 34 and the cam pulley 42. The crank pulley 35 is connected to a portion of the second crankshaft 24 leading to the outside. The cam pulley 43 is connected to a camshaft 45 together with a first exhaust cam 37 which controls advancing-and-retracting motion of the first exhaust valve 18 by coming into contact with the first exhaust valve 18 and a second exhaust cam 39 which controls advancing-and-retracting motion of a second exhaust valve 28 by coming into contact with the second exhaust valve 28. The first exhaust cam 37 and the second exhaust cam 39 are connected to the camshaft 45 with such a phase difference that the timing at which the first exhaust cam 37 presses the first exhaust valve 18 and the timing at which the second exhaust cam 39 presses the second exhaust valve 28 come concurrently. In addition, a tensioner 33 for applying tension to the timing belt 31 is arranged.

Here, the first intake valve 17 and the first exhaust valve 18 described above are biased in a direction away from the first cylinder 12 by biasing members such as springs not illustrated. Similarly, the second intake valve 27 and the second exhaust valve 28 are biased in a direction away from the second cylinder 22 by biasing members such as springs not illustrated.

When the first intake cam 36 and the second intake cam 38 are connected to the camshaft 44 and the first exhaust cam 37 and the second exhaust cam 39 are connected to the camshaft 45 as described above, the number of camshafts is decreased to reduce the number of components in the opposed-piston engine 10, so that further reductions in the size and the weight can be achieved.

As illustrated in FIG. 1B, a second counter-rotating gear 47 is connected to the camshaft 45 to which the first exhaust cam 37 and so on are attached. The second counter-rotating gear 47 is a part of a crankshaft counter-rotation synchronization mechanism 29 by which the rotation direction of the first crankshaft 14 and the rotation direction of the second crankshaft 24 is set opposite to each other, and the crankshaft counter-rotation synchronization mechanism 29 is described below with reference to FIG. 2.

Figure 2A:
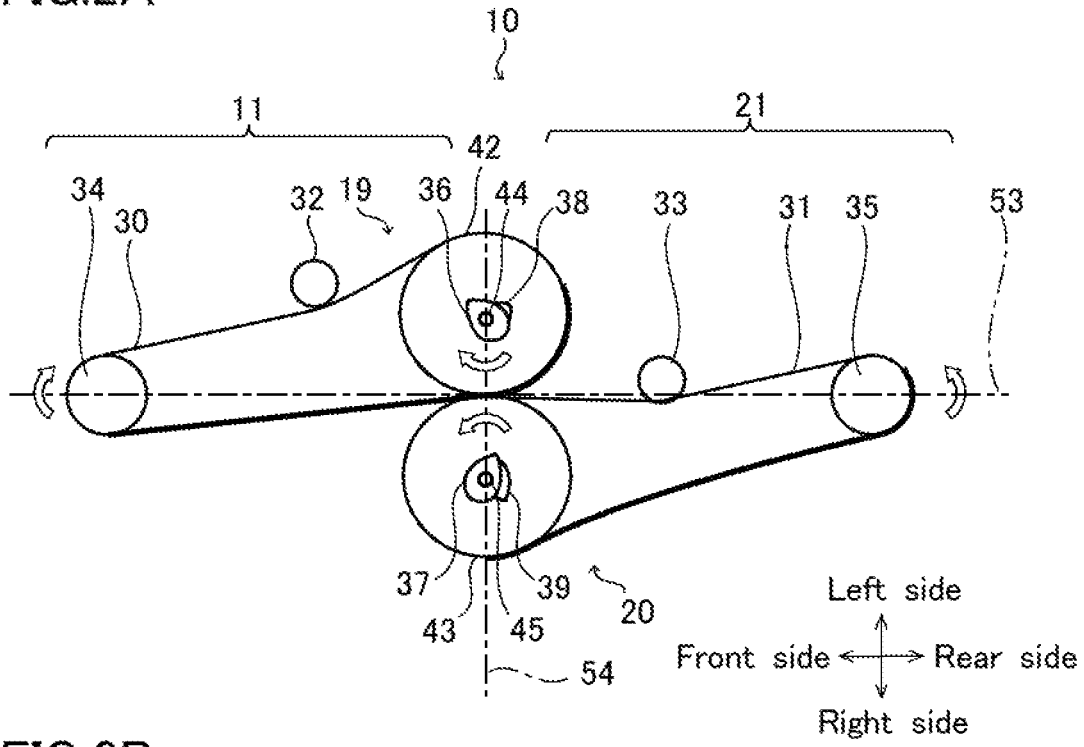
Figure 2B:
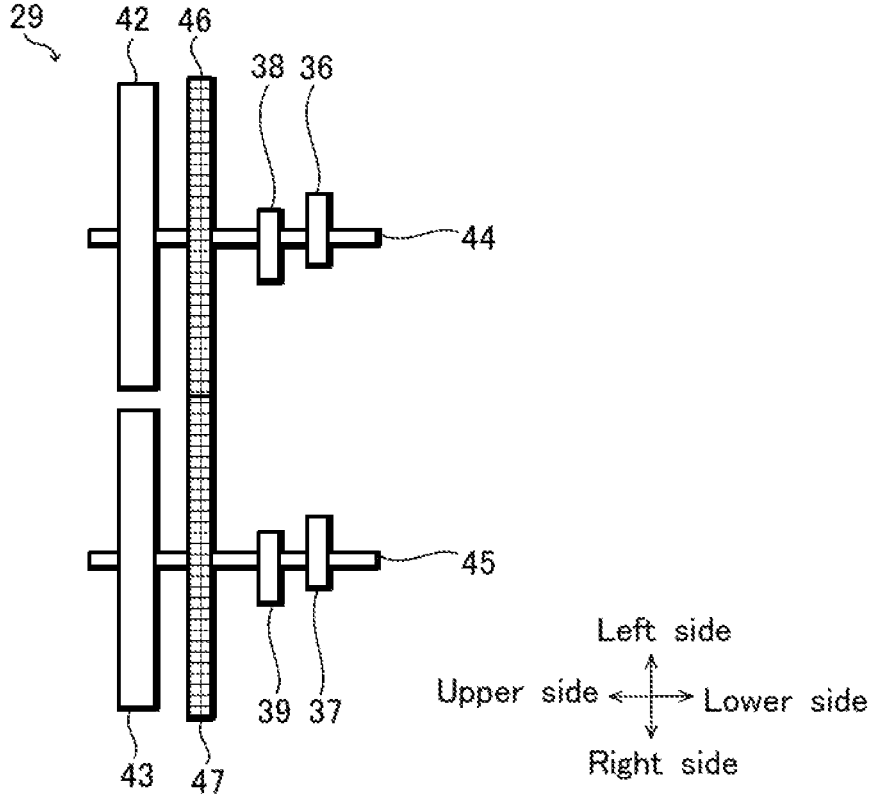

With reference to FIG. 2, the crankshaft counter-rotation synchronization mechanism 29 is described. FIG. 2A is a top view illustrating the first valve driving mechanism 19 and the second valve driving mechanism 20 included in the opposed-piston engine 10, and FIG. 2B is a front view of the crankshaft counter-rotation synchronization mechanism 29 viewed from the front side.

As illustrated in FIG. 2A, in the opposed-piston engine 10, the rotation direction of the first crankshaft 14 and the rotation direction of the second crankshaft 24, which are not illustrated in FIG. 2A, are set opposite to each other so as to reduce vibrations.

In this embodiment, when the opposed-piston engine 10 is viewed from above, the crank pulley 34 connected to the first crankshaft 14 not illustrated rotates clockwise and the cam pulley 42 connected to the crank pulley 34 via the timing belt 30 also rotates clockwise. Moreover, the first intake cam 36 and the second intake cam 38 also rotate clockwise.

On the other hand, the crank pulley 35 connected to the second crankshaft 24 not illustrated rotates counterclockwise and the cam pulley 43 connected to the crank pulley 35 via the timing belt 31 also rotates counterclockwise. Moreover, the first exhaust cam 37 and the second exhaust cam 39 also rotate counterclockwise.

In other words, the members included in the first valve driving mechanism 19 rotate clockwise, whereas the members included in the second valve driving mechanism 20 rotate counterclockwise.

With reference to FIG. 2B, a first counter-rotating gear 46 is connected to the camshaft 44, and the second counter-rotating gear 47 is connected to the camshaft 45. The first counter-rotating gear 46 and the second counter-rotating gear 47 are identical in terms of the diameter and the number of teeth. When the first counter-rotating gear 46 and the second counter-rotating gear 47 thus configured mesh with each other, the rotation direction of the first counter-rotating gear 46 and the rotation direction of the second counter-rotating gear 47 are opposite to each other. Thus, the rotation direction of the cam pulley 42 connected to the first counter-rotating gear 46 via the camshaft 44 and the rotation direction of the cam pulley 43 connected to the second counter-rotating gear 47 via the camshaft 45 are also opposite to each other. In addition, as illustrated in FIG. 2A, the timing belt 30 is wrapped around the cam pulley 42 and the crank pulley 34 and the timing belt 31 is wrapped around the cam pulley 43 and the crank pulley 35. Thus, the rotation direction of the crank pulley 34 and the rotation direction of the crank pulley 35 are also opposite to each other. According to the above description, with the configuration in which the first counter-rotating gear 46 and the second counter-rotating gear 47 mesh with each other, the rotation direction of the first crankshaft 14 and the rotation direction of the second crankshaft 24 illustrated in FIG. 1A are set opposite to each other to achieve counter rotations during an operation, so that a rotational reaction force generated from the first crankshaft 14 and a rotational reaction force generated from the second crankshaft 24 can be canceled out to reduce vibrations.

With reference to FIG. 1A, the first cylinder 12 of the first engine unit 11 and the second cylinder 22 of the second engine unit 21 are not formed as a continuous space, but are formed as separate combustion chambers. In this configuration, firstly, the first cylinder 12 and the second cylinder 22 are formed as substantially cylindrical spaces. Thus, the combustion chambers have simpler shapes than the cylinder of the engine according to the background art, which has a complicated shape, so that the output can be increased by enhancing the intake effect and the exhaust effect. In addition, since the first cylinder 12 and the second cylinder 22 have the substantially cylindrical shapes, the heat transfer in the first cylinder 12 and the second cylinder 22 during the operation of the opposed-piston engine 10 can be made substantially uniform, so that deformation of the first cylinder 12 and the second cylinder 22 during the operation can be suppressed.

Moreover, in the present embodiment, the first cylinder 12 in the first engine unit 11 and the second cylinder 22 in the second engine unit 21 individually include the intake valves and the exhaust valves. Specifically, the first intake valve 17 is arranged on a rear-end left side in the first cylinder 12 in the first engine unit 11 and the first exhaust valve 18 is arranged on a rear-end right side in the first cylinder 12. Thus, a flow path 55 for a mixture gas and an exhaust gas flowing through the first cylinder 12 during the operation of the engine is simplified, and the combustion toughness can be enhanced due to the simplification of the flow path 55 and the simplification of the combustion chamber shape. Similarly, the second intake valve 27 is arranged on a front-end left side in the second cylinder 22 in the second engine unit 21 and the second exhaust valve 28 is arranged on a front-end right side in the first cylinder 12. Thus, a flow path 56 for a mixture gas and an exhaust gas flowing through the second cylinder 22 during the operation of the engine is simplified, and the combustion toughness can be enhanced as is the case with the first cylinder 12.

In addition, in the opposed-piston engine 10 in the present embodiment, the valve driving mechanisms also function as the crankshaft counter-rotation synchronization mechanism 29. Specifically, a counter-rotating mechanism to rotate the first crankshaft 14 and the second crankshaft 24 in the opposite directions is needed in order to reduce vibrations in the opposed-piston engine 10 during the operation. However, if a mechanism dedicated for rotations in the opposite directions is provided for the opposed-piston engine 10, the number of components included in the opposed-piston engine 10 increases, which leads to the complicated configuration of the opposed-piston engine 10 and also an increase in the cost. In this regard, in the present embodiment, the first valve driving mechanism 19 and the second valve driving mechanism 20 illustrated in FIG. 2A constitute a part of the crankshaft counter-rotation synchronization mechanism 29 which rotates the first crankshaft 14 and the second crankshaft 24 in the opposite directions.

Specifically, with reference to FIG. 2A, the crank pulley 34, the timing belt 30, the tensioner 32, the cam pulley 42, and the camshaft 44 in the first valve driving mechanism 19 constitutes a part of the crankshaft counter-rotation synchronization mechanism 29. In addition, the crank pulley 35, the timing belt 31, the tentioner 33, the cam pulley 43, and the camshaft 45 in the second valve driving mechanism 20 constitute a part of the crankshaft counter-rotation synchronization mechanism 29. These members together with the first counter-rotating gear 46 and the second counter-rotating gear 47 illustrated in FIG. 2B constitute the crankshaft counter-rotation synchronization mechanism 29. Thus, most of the members constituting the crankshaft counter-rotation synchronization mechanism 29 are the members included in the first valve driving mechanism 19 and the second valve driving mechanism 20, and the components dedicated to the crankshaft counter-rotation synchronization mechanism 29 are only the first counter-rotating gear 46 and the second counter-rotating gear 47. In this way, an increase in the number of components and the like by providing the crankshaft counter-rotation synchronization mechanism 29 are suppressed.

The first counter-rotating gear 46 and the second counter-rotating gear 47 which establish the aforementioned counter rotations just synchronize the phases of the first crankshaft 14 and the second crankshaft 24 and do not transmit large rotational torques generated from the first crankshaft 14 and the second crankshaft 24. For this reason, the first counter-rotating gear 46 and the second counter-rotating gear 47 do not require high strength. Accordingly, the widths of the first counter-rotating gear 46 and the second counter-rotating gear 47 may be thin, and an inexpensive material required to have only low strength may be employed as a material for the first counter-rotating gear 46 and the second counter-rotating gear 47. This makes it possible to prevent increases in the cost and the weight due to the employment of the first counter-rotating gear 46 and the second counter-rotating gear 47.

Here, operations of the opposed-piston engine 10 are described with reference to the drawings described above. The first engine unit 11 and the second engine unit 21 included in the opposed-piston engine 10 are four stroke engines, and therefore repeat an intake stroke, a compression stroke, a combustion stroke, and an exhaust stroke. Here, the first engine unit 11 and the second engine unit 21 simultaneously perform the intake stroke, the compression stroke, the combustion stroke, and the exhaust stroke.

With reference to FIG. 1A, the operations in the respective strokes of the first engine unit 11 are described below. First, in the intake stroke, the first piston 13 moves toward the front in the first cylinder 12 in a state where the first intake valve 17 pressed by the first intake cam 36 is advanced and the first exhaust valve 18 not pressed by the first exhaust cam 37 is retracted. Thus, a mixture gas which is a mixture of fuel (for example, a gasoline) and air is introduced into the first cylinder 12. In the compression stroke, the first intake valve 17 not pressed by the first intake cam 36 is retracted and the first exhaust valve 18 not pressed by the first exhaust cam 37 is also retracted. In this state, the first piston 13 is pushed toward the rear due to the inertia of the rotating first crankshaft 14, and the mixture gas is compressed in the first cylinder 12. Next, in the combustion stroke, an ignition plug not illustrated ignites in the first cylinder 12, so that the mixture gas burns in the first cylinder 12 and thereby the first piston 13 is pushed out to a front end at the bottom dead center. After that, in the exhaust stroke, the first intake valve 17 not pressed by the first intake cam 36 is retracted, and the first exhaust valve 18 pressed by the first exhaust cam 37 is advanced. In this state, the first piston 13 is pushed toward the rear due to the inertia of the rotating first crankshaft 14, and the burned gas present inside the first cylinder 12 is discharged to the outside.

The operations in the respective strokes of the second engine unit 21 are described below. First, in the intake stroke, the second piston 23 moves toward the rear in the second cylinder 22 in a state where the second intake valve 27 pressed by the second intake cam 38 is advanced and the second exhaust valve 28 not pressed by the second exhaust cam 39 is retracted. Thus, a mixture gas which is a mixture of fuel (for example, a gasoline) and air is introduced into the second cylinder 22. In the compression stroke, the second intake valve 27 not pressed by the second intake cam 38 is retracted and the second exhaust valve 28 not pressed by the second exhaust cam 39 is also retracted. In this state, the second piston 23 is pushed toward the front due to the inertia of the rotating second crankshaft 24, and the mixture gas is compressed in the second cylinder 22. Next, in the combustion stroke, an ignition plug not illustrated ignites in the second cylinder 22, so that the mixture gas burns in the second cylinder 22 and thereby the second piston 23 is pushed out to a rear end at the bottom dead center. After that, in the exhaust stroke, the second intake valve 27 not pressed by the second intake cam 38 is retracted, and the second exhaust valve 28 pressed by the second exhaust cam 39 is advanced. In this state, the second piston 23 is pushed to the front due to the inertia of the second crankshaft 24, and the burned gas present inside the second cylinder 22 is discharged to the outside.

While the strokes are repeated as described above, the first counter-rotating gear 46 and the second counter-rotating gear 47 rotate in the opposite directions, since the first counter-rotating gear 46 connected to the camshaft 44 and the second counter-rotating gear 47 connected to the camshaft 45 mesh with each other as illustrated in FIG. 2B. For example, when the first counter-rotating gear 46 and the second counter-rotating gear 47 are viewed from above, the first counter-rotating gear 46 rotates clockwise, whereas the second counter-rotating gear 47 rotates counterclockwise. Thus, as illustrated in FIG. 1A, the cam pulley 42, the first intake cam 36, and the second intake cam 38 connected to the camshaft 44 together with the first counter-rotating gear 46 rotate clockwise when viewed from above. Similarly, the cam pulley 43, the first exhaust cam 37, and the second exhaust cam 39 connected to the camshaft 45 together with the second counter-rotating gear 47 rotate counterclockwise when viewed from above.

Since the timing belt 30 is wrapped around the cam pulley 42 and the crank pulley 34, the crank pulley 34 rotates clockwise, whereby the first crankshaft 14 rotates clockwise when viewed from above. On the other hand, since the timing belt 31 is wrapped around the cam pulley 43 and the crank pulley 35, the crank pulley 35 rotates counterclockwise, whereby the second crankshaft 24 also rotates counterclockwise when viewed from above.

In sum, the configuration where the first counter-rotating gear 46 and the second counter-rotating gear 47 are set to mesh with each other as described above is capable of rotating the first crankshaft 14 and the second crankshaft 24 in the opposite directions when the opposed-piston engine 10 is operated, so that the counter rotations can be achieved to reduce vibrations.

With reference to FIG. 3, another embodiment of an opposed-piston engine 10 is described. FIG. 3 is a side view of the opposed-piston engine 10 according to the other embodiment when viewed from the right side. A basic configuration of the opposed-piston engine 10 illustrated in FIG. 3 is basically the same as that described with reference to FIG. 1 and so on, and is only different in that an oil pan 48 and so on are included. In addition, FIG. 3 depicts channels of oil flow by arrows.

In the present embodiment, since the first engine unit 11 and the second engine unit 21 are arranged opposed to each other, components which can be shared by the first engine unit 11 and the second engine unit 21 are placed concentratedly in an anteroposterior center area of the opposed-piston engine 10.

Specifically, the cylinder head 52 arranged in the anteroposterior center area of the opposed-piston engine 10 can be shared by the first engine unit 11 and the second engine unit 21. In the cylinder head 52, an exhaust port 50 and an intake port to be described later are formed, and they are shared by the first engine unit 11 and the second engine unit 21. In addition, the arrangement of the cylinder head 52 as described above enables the first engine unit 11 and the second engine unit 21 to share the camshafts 44 and 45.

In addition, the oil pan 48 is placed at a bottom portion in the anteroposterior center area of the opposed-piston engine 10. The oil pan 48 stores oil for lubrication and cooling to be supplied to the components in the opposed-piston engine 10. In addition, an oil pump 49 for causing the oil stored in the oil pan 48 to circulate through the components in the opposed-piston engine 10 is arranged in the anteroposterior center area of the opposed-piston engine 10. The oil pump 49 is driven by a driving force of the camshaft 45. Flow channels through which the oil circulates are formed in the opposed-piston engine 10. Thus, the oil sent out by the oil pump 49 is first supplied to the components included in the first engine unit 11 and the second engine unit 21 and then is returned to the oil pan 48 through the flow channels.

Here, there is another application example in which a water pump for sending out cooling water for engine cooling is placed in addition to the oil pump 49. The water pump is a pump for circulating cooling water for cooling the opposed-piston engine 10.

In addition, the exhaust port 50 through which the exhaust gas from the first engine unit 11 and the second engine unit 21 is discharged all together to the outside of the system is formed in the anteroposterior center area of the opposed-piston engine 10. Further, at a position opposed to the exhaust port 50, formed is the intake port, not illustrated, through which air to be introduced to the first engine unit 11 and the second engine unit 21 is introduced all together from the outside of the system.

When the functional components such as the oil pan 48 are placed concentratedly in the anteroposterior center area of the opposed-piston engine 10 as described above, the functional components can be shared by the first engine unit 11 and the second engine unit 21, so that the number of components included in the opposed-piston engine 10 can be reduced.

Although the embodiments of the present invention are described above, the present invention should not be limited to the aforementioned embodiments.

For example, chains or gear trains may be used in place of the timing belts 30 and 31 illustrated in FIG. 1A and so on.

REFERENCE SIGNS LIST

10 opposed-piston engine
11 first engine unit
12 first cylinder
13 first piston
14 first crankshaft
15 first connecting rod
16 first valve
17 first intake valve
18 first exhaust valve
19 first valve driving mechanism
20 second valve driving mechanism
21 second engine unit
22 second cylinder
23 second piston
24 second crankshaft
25 second connecting rod
26 second valve
27 second intake valve
28 second exhaust valve
29 crankshaft counter-rotation synchronization mechanism
30 timing belt
31 timing belt
32 tentioner
33 tentioner
34 crank pulley
35 crank pulley
36 first intake cam
37 first exhaust cam
38 second intake cam
39 second exhaust cam
40 first load
41 second load
42 cam pulley
43 cam pulley
44 camshaft
45 camshaft
46 first counter-rotating gear
47 second counter-rotating gear
48 oil pan
49 oil pump
50 exhaust port
52 cylinder head
53 imaginary line
54 imaginary line
55 flow path
56 flow path

The invention claimed is:

1. An opposed-piston engine comprising:

a first engine unit including a first cylinder, a first piston which reciprocates inside the first cylinder, a first crankshaft which converts reciprocating motion of the first piston into rotating motion, a first connecting rod which connects the first piston to the first crankshaft in a movable manner, and a first valve which is arranged in the first cylinder;

a second engine unit including a second cylinder which is separate from and opposed to the first cylinder, a second piston which reciprocates inside the second cylinder, a second crankshaft which converts reciprocating motion of the second piston into rotating motion, a second connecting rod which connects the second piston to the second crankshaft in a movable manner, and a second valve which is arranged in the second cylinder;

a cylinder head disposed between the first engine unit and the second engine unit;

a valve driving mechanism which drives the first valve and the second valve; and a crankshaft counter-rotation synchronization mechanism by which a rotation direction of the first crankshaft and a rotation direction of the second crankshaft are set opposite to each other, wherein the valve driving mechanism functions as the crankshaft counter-rotation synchronization mechanism, and wherein the cylinder head defines a first combustion chamber within the first cylinder and further defines a second combustion chamber within the second cylinder such that the first combustion chamber is separate from the second combustion chamber.

2. The opposed-piston engine according to claim 1, wherein:

the first valve includes a first intake valve and a first exhaust valve, the second valve includes a second intake valve, and a second exhaust valve, and the valve driving mechanism controls opening and closing of the first intake valve and the second intake valve via a driving force of the first crankshaft and controls opening and closing of the first exhaust valve and the second exhaust valve via a driving force of the second crankshaft.

3. The opposed-piston engine according to claim 1, wherein:

the crankshaft counter-rotation synchronization mechanism includes a first counter-rotating gear meshing with a second counter-rotating gear, the first counter-rotating gear configured to be rotated by a driving force of the first crankshaft and is connected to a first camshaft including a first cam which operates one of the first valve or the second valve, the second counter-rotating gear configured to be rotated by a driving force of the second crankshaft and is connected to a second camshaft including a second cam which operates a remaining one of the first valve or the second valve.

4. The opposed-piston engine according to claim 1, further comprising an oil pan arranged in a center location between the first cylinder and the second cylinder, and stores oil that circulates through the first engine unit and the second engine unit.

5. The opposed-piston engine according to claim 1, further comprising an oil pump driven by the valve driving mechanism.

* * * * *